US006422896B2

(12) United States Patent
Aoki et al.

(10) Patent No.: US 6,422,896 B2
(45) **Date of Patent: *Jul. 23, 2002**

(54) FLAT CIRCUIT MEMBER CONNECTOR

(75) Inventors: Hiroshi Aoki; Hiroki Kondo, both of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/791,897

(22) Filed: Feb. 26, 2001

(30) Foreign Application Priority Data

Feb. 25, 2000 (JP) ..... 2000-049441

(51) Int. Cl.[7] ..... H01R 12/24

(52) U.S. Cl. ..... 439/499; 439/456; 439/701; 439/494; 439/498; 439/492

(58) Field of Search ..... 439/499, 492, 439/495, 498, 422, 456, 701, 494

(56) References Cited

U.S. PATENT DOCUMENTS

| | | | | |
|---|---|---|---|---|
| 3,881,796 A | * | 5/1975 | Saunders | 439/422 |
| 3,923,364 A | | 12/1975 | Shapiro et al. | |
| 4,265,507 A | * | 5/1981 | Johnson | 439/495 |
| 4,285,561 A | * | 8/1981 | Chow | 439/422 |
| 5,041,009 A | * | 8/1991 | McCleerey | 439/405 |
| 5,385,478 A | * | 1/1995 | Niekawa | 439/495 |
| 5,954,537 A | | 9/1999 | Sonobe et al. | |

FOREIGN PATENT DOCUMENTS

| | | |
|---|---|---|
| DE | 197 34 872 A1 | 3/1999 |
| JP | 7-42045 | 7/1995 |
| JP | 9-73958 | 3/1997 |

* cited by examiner

*Primary Examiner*—Tho D. Ta
(74) *Attorney, Agent, or Firm*—Sughrue Mion, PLLC

(57) ABSTRACT

A connector (10) comprises a housing (20), at least one terminal (15) receivable in the housing (20), and a fixing mechanism (25, 26) fixable to the housing (20). The terminal (15) has a contact surface (18) extended in a thickness direction thereof. When the fixing mechanism (25, 26) is fixed to the housing (20) so that a flat circuit member (12) having a conductor portion (13) is held between the housing (20) in which the terminal (15) is received and the fixing mechanism (25, 26), the fixing mechanism (25, 26) bends a part of the flat circuit member (12) in a thickness direction thereof to form a bent portion (14*a*) thereon, and presses the bent portion (14*a*) of the flat circuit member (12) against the contact surface (18) of the terminal (15) so that the terminal (15) is electrically connected to the conductor portion (13) of the flat circuit member (12).

12 Claims, 3 Drawing Sheets

FLAT CIRCUIT MEMBER CONNECTOR

BACKGROUND OF THE INVENTION

1. Field of the Invention

The present invention relates to a connector for a flat circuit member. More particularly, the present invention relates to a flat circuit member connector which can be positively connected to conductor portions of a flat circuit member such, for example as a ribbon cable, an FFC (i.e., Flexible Flat Circuit) and an FPC (i.e., Flexible Printed Circuit).

The present application is based on Japanese Patent Application No. 2000-49441, which is incorporated herein by reference.

2. Description of the Related Art

One example of conventional connectors for connection to a flat circuit member, such as a ribbon cable, an FFC and an FPC, is "Flat Cable Connection Connector" disclosed in Unexamined Japanese Patent Publication No. Hei. 9-73958. This conventional example will now be described with reference to FIG. 5.

As shown in FIG. 5, the flat cable connection connector 60 comprises a housing 61, having an opening 65 for receiving a distal end portion of an FPC cable as a flat circuit member, contacts 66 which are received in the opening 65 so as to be pressed against an electric circuit pattern (not shown) on the FPC cable 62, and a slider portion 67 of metal provided in opposed relation to the contacts 66. An insulating abutment portion 68 for preventing leakage of the electric circuit pattern is mounted on the slider portion 67.

The FPC cable 62 has the electric circuit pattern formed on a lower surface thereof, and also has a plate-like reinforcing member 63 mounted on an upper surface thereof at the distal end portion thereof.

For connecting the FPC cable 62 to the flat cable connection connector 60, the FPC cable 62 is inserted into the opening 65 in the housing 61 while sliding the plate-like reinforcing member 63 along the slider portion 67. As a result, the FPC cable 62 is held between the slider portion 67 and the contacts 66, and a contact portion 66*a* of each contact 66 is held in contact with the electric circuit pattern on the FPC cable 62.

In the above conventional example, however, the FPC cable 62 is held between the slider portion 67 and the contacts 66 along the direction of the thickness of this cable, and by doing so, the FPC cable 62 is fixed to the housing 61, and therefore there has been encountered a problem that when the FPC cable 62 is pulled in the longitudinal direction (as indicated by an arrow in FIG. 5), the FPC cable 62 can be easily disengaged from the opening 65.

And besides, in the above conventional example, the slider portion 67 is needed for holding the FPC cable 62, and also the insulating abutment portion 68 is needed for preventing the leakage of the electric circuit pattern. Therefore, the number of the component parts is large, which has invited a problem that the production cost of the flat cable connection connector 60 is high.

Furthermore, in the above conventional example, the contact point of the contact portion 66*a* of the contact 66 for contact with the electric circuit pattern is defined by a shearing surface formed by pressing, and therefore the value of the electric resistance relative to the electric circuit pattern on the FPC cable 62 is not constant under severe conditions in which severe vibrations are applied to the connector, and this invites a problem that the incomplete connection is liable to occur.

SUMMARY OF THE INVENTION

The present invention has been made in view of the above problems, and an object of the present invention is to provide a flat circuit member connector which can be positively connected to a flat circuit member, and in which the number of component parts can be reduced, and the electric resistance value can be obtained in a stable manner.

To achieve the above object, according to the first aspect of the present invention, there is provided a connector which comprises a housing, at least one terminal receivable in the housing, the terminal having a contact surface extended in a thickness direction thereof, and a fixing mechanism fixable to the housing, wherein when the fixing mechanism is fixed to the housing so that a flat circuit member having a conductor portion is held between the housing in which the terminal is received and the fixing mechanism, the fixing mechanism bends a part of the flat circuit member in a thickness direction thereof to form a bent portion thereon, and presses the bent portion of the flat circuit member against the contact surface of the terminal so that the terminal is electrically connected to the conductor portion of the flat circuit member.

Examples of the flat circuit member include a ribbon cable, an FFC and an FPC. In the case where a ribbon cable is used as the flat circuit member, insulating layers of wires are uniformly peeled, and by doing so, the flat circuit member connector of the present invention can be adopted.

The contact surface can be formed, for example, by bending a predetermined portion of the terminal into a substantially convex shape, or by bending an end portion of the terminal into a substantially L-shape in the direction of the thickness of the terminal.

In the case where the predetermined portion of the terminal is bent into a substantially convex shape to form the contact surface, a pair of opposed contact surfaces may be formed by bending two portions of the terminal spaced a predetermined distance from each other in the longitudinal direction.

In the case where the terminal has the pair of opposed contact surfaces, the bent portion, formed by bending an end portion or an intermediate portion of the flat circuit member into a substantially convex shape in such a manner that the surface of the flat circuit member, on which the conductor portions are formed, projects toward the housing, is inserted between the two contact surfaces, and by doing so, each conductor portion of the flat circuit member is held in surface-to-surface contact with each contact surface of the corresponding terminal.

In the case where the terminal has the pair of opposed contact surfaces, the fixing mechanism can have a bar-like member for fitting into the space between the pair of contact surfaces through the flat circuit member, and in this case this bar-like member can be formed integrally with a rear holder, engageable with the housing, so that the bar-like member can be held in a fitted condition.

In the flat circuit member connector of this construction, the flat circuit member is fixed in such a manner that the bent portion of the flat circuit member is held in press-contact with the contact surface of the terminal extending in the direction of the thickness thereof, and therefore the flat circuit member will not be easily disengaged from the housing even when it is pulled in the longitudinal direction, and the housing can be positively kept connected to the flat circuit member.

In the flat circuit member connector, the flat circuit member is fixed by the fixing mechanism in such a manner that the bent portion of the flat circuit member is held in press-contact with the contact surface, and thus the fixing is achieved with this very simple construction. Therefore, as compared with the conventional construction, the number of the component parts is reduced, and the production cost can be reduced.

And besides, in this flat circuit member connector, each terminal is disposed in surface-to-surface contact with the corresponding conductor portion of the flat circuit member through the contact surface, and therefore the electric resistance value can be obtained in a stable manner even under severe conditions in which severe vibrations are applied to the connector, and this eliminates the possibility of incomplete connection as encountered in the conventional construction.

According to the second aspect of the present invention, it is preferable that the fixing mechanism includes a recess portion formed in the housing so that the contact surface of the terminal is exposed to an exterior through the recess portion, and a lid member fittable in the recess portion to cover the recess portion, and wherein the bent portion is held between the recess portion and the lid member. In the flat circuit member connector of this construction, the area of contact between each conductor portion of the flat circuit member and the contact surface of the terminal is covered with the lid member, and therefore the contact area is protected from dirt, dust, water and so on, and besides adverse effects, caused by an impact, a drag and others, can be relieved.

According to the third aspect of the present invention, the flat circuit member can be bent into a substantially crank shape, that is, that portion of the flat circuit member, disposed immediately adjacent to the distal end portion thereof bent into a substantially L-shape, can be bent into a substantially L-shape, and therefore the housing can be more positively kept connected to the flat circuit member as compared with the case where the flat circuit member is merely bent into a substantially L-shape.

According to the fourth aspect of the present invention, the terminal may have a pair of the contact surfaces, and wherein the pair of contact surfaces are spaced a predetermined distance from each other in a longitudinal direction of the terminal, and are opposed to each other.

In this flat circuit member connector, thus, the terminal has the pair of opposed contact surfaces, and therefore the flat circuit member is fitted into the space between the pair of contact surfaces in a bent manner.

According to the fifth aspect of the present invention, the lid member may have a projection fittable in the recess portion, so that the bent portion is held between the projection and the recess portion.

According to the sixth aspect of the present invention, it is preferable that the fixing mechanism includes a lid member having at least one projection, and wherein when the fixing mechanism is fixed to the housing, the flat circuit member is held between the projection and a rear end of the terminal and also between the projection and the housing.

Therefore, in this flat circuit member connector, the housing can be more positively kept connected to the flat circuit member as compared with the case where the flat circuit member is merely bent into a substantially L-shape.

In this flat circuit member connector, the pair of contact surfaces of each terminal are held in surface-to-surface contact with the corresponding conductor portion of the flat circuit member, and therefore the area of contact of the terminal with the conductor portion of the flat circuit member increases, and this further reduces the possibility of incomplete connection due to severe vibrations.

DETAILED DESCRIPTION OF THE PREFERRED EMBODIMENT

A preferred embodiment of the present invention will now be described in detail with reference to FIGS. 1 to 4.

Figure 1:
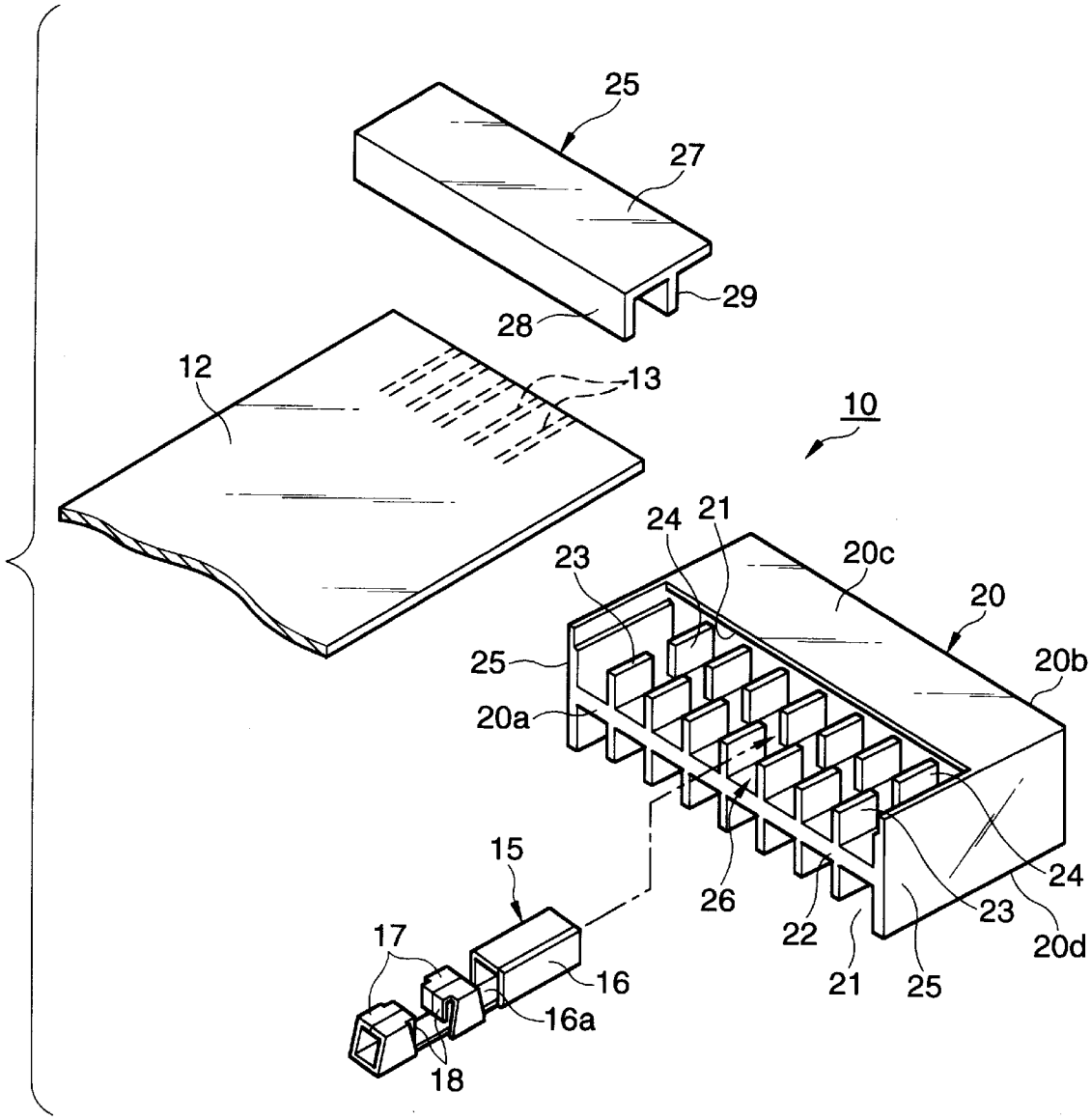
FIG. 1 is an exploded, perspective view of a flat circuit member connector of the present invention.

As shown in FIG. 1, a flat circuit member connector 10, embodying the present invention, comprises a housing 20 for receiving many terminals 15 (in such a manner that the terminals 15 are isolated from one another) so that the terminals 15 can be connected to conductor portions 13 of a flat circuit member 12, and a fixing mechanism 25 each of which holds the flat circuit member 12 on the housing 20, and keeps the terminals 15 in press-contact with the conductor portions 13.

The housing 20 is formed into a substantially rectangular parallelepiped shape, using a suitable insulative resin, and this housing has many recess portions 26 extending from one longer side surface 20*a* (front side surface in FIG. 1) thereof to the other longer side surface 20*b* thereof. The terminals 15 can be inserted into these recess portions 26, respectively. The recess portions 26 are arranged in two rows through a partition plate 22.

Notches 21 and 21 are formed in upper and lower surfaces 20*c* and 20*d* of the housing 20, respectively, and each of these notches extends from a central portion of the surface 20*c*, 20*d* to the longer side surface 20*a*. The recess portions 26 are separated from one another by a plurality of pairs of partition walls 23 and 24, and each pair of partition walls 23 and 24 are disposed in a common plane, and are spaced from one another. The partition walls 23 and 24 are exposed to the exterior through the notches 21. The partition walls 23 and 24 are covered with corresponding flat plate-like lid members 27 (only one of which is shown) fitted respectively in the notches 21 and 21.

The flat circuit member 12 is in the form of an FPC or an FFC, and has the conductor portions 13 of metal formed on one side of a flexible, band-like board.

Figure 2:
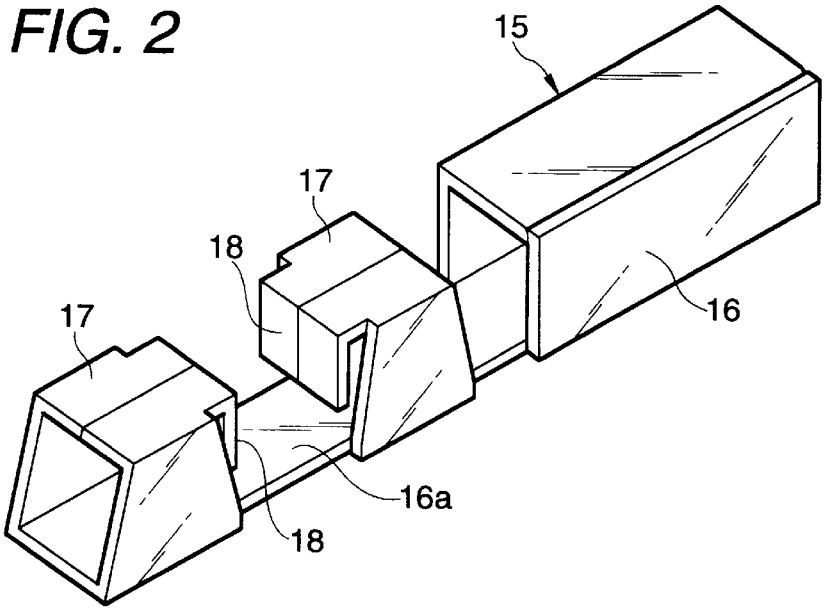
FIG. 2 is an enlarged perspective view of a terminal in FIG. 1.

As shown in FIG. 2, the terminal 15 includes a female terminal portion 16 of a substantially square tubular shape for connection to a male terminal (not shown), a strip-like extension portion 16*a* extending from the female terminal portion 16 in a longitudinal direction, planar contact portions 17 and 17 each of which is defined by distal end portions of side walls extending upwardly respectively from opposite side (widthwise side) edges of the extension portion 16*a* in a direction of the thickness thereof, and is parallel to the surface of the extension portion 16*a*, and contact surfaces 18 and 18 which are supported respectively by the contact portions 17, and extend in the direction of the thickness of the extension portion 16*a*.

Figure 3:
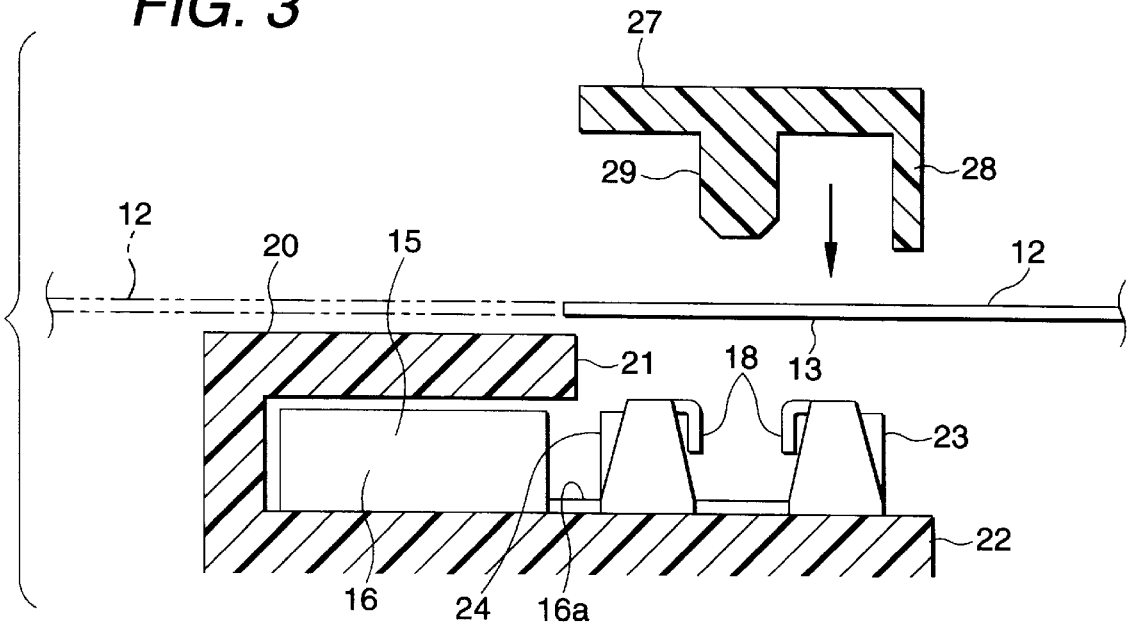
FIG. 3 is a cross-sectional view showing the procedure of connecting the flat circuit member connector to a flat circuit member.

The sum of the thickness of the extension portion 16*a* and the height of the side wall of the contact portion 17 is larger than the vertical dimension of the partition walls 23 and 24. Namely, upper portions of the contact portions 17 are projected from upper surfaces of the partition walls 23 and 24 as shown in FIG. 3.

The contact surfaces 18 and 18 are provided respectively at predetermined positions, spaced from each other in a longitudinal direction of the extension portion 16*a*, and are disposed in opposed relation to each other. The distance between the contact surfaces 18 and 18 is smaller than the distance between each pair of partition walls 23 and 24.

Each of the terminals 15 is formed by blanking an electrically-conductive metal sheet into a predetermined shape and then by suitably bending it, so that the female terminal portion 16, the contact portions 17 and 17 and the contact surfaces 18 and 18 are formed.

When the terminal 15 is inserted into the recess portion 26 in the housing 20 until the distal end surface of the female terminal portion 16 abuts against an abutment portion on the housing, the contact surfaces 18 and 18 are disposed offset respectively from the opposed ends of each pair of partition walls 23 and 24 in a direction toward each other. Namely, the contact surfaces 18 and 18 are located between the opposed ends of each pair of partition walls 23 and 24 in a direction opposing to each other as shown in FIG. 3.

The fixing mechanism 25 has a pair of elongate projections 28 and 29 formed on the lid member 27. The elongate projections 28 and 29 are formed on a reverse surface of the lid member 27 which is to face the housing 20, and these continuous elongate projections 28 and 29 extend in a longitudinal direction of the lid member 27 in parallel relation to each other.

When the lid member 27 of the fixing mechanism is fitted in the notch 21, the elongate projection 29 is disposed between the contact surfaces 18 and 18 of each terminal 15 while the elongate projection 28 covers the rear ends of the terminals 15.

At this time, the elongate projection 29 is disposed between the contact surfaces 18 and 18 such that a gap between the elongate projection 29 and each contact surface 18 is smaller than the thickness of the flat circuit member 12.

On the other hand, the elongate projection 28 is disposed relative to the rear ends of the terminals 15 and the housing 20 such that a gap between the elongate projection 28 and the rear ends of the terminals 15, as well as a gap between the elongate projection 28 and the housing 20, is smaller than the thickness of the flat circuit member 12.

Next, the procedure of connecting the flat circuit member 12 to the flat circuit member connector 10 will be described.

First, the terminals 15 are inserted into the recess portions 26 in the housing 20, and the flat circuit member 12 is arranged in such a manner that the conductor portions 13 face the housing 20 and that the end portion of the flat circuit member 12 almost covers the notch 21, as shown in FIG. 3.

Figure 4:
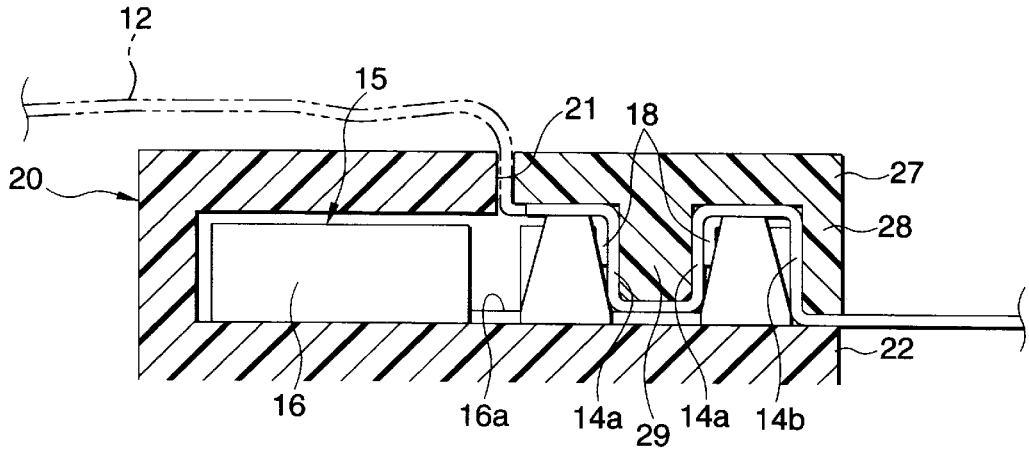
FIG. 4 is a cross-sectional view showing the procedure of connecting the flat circuit member connector to the flat circuit member.
Figure 5:
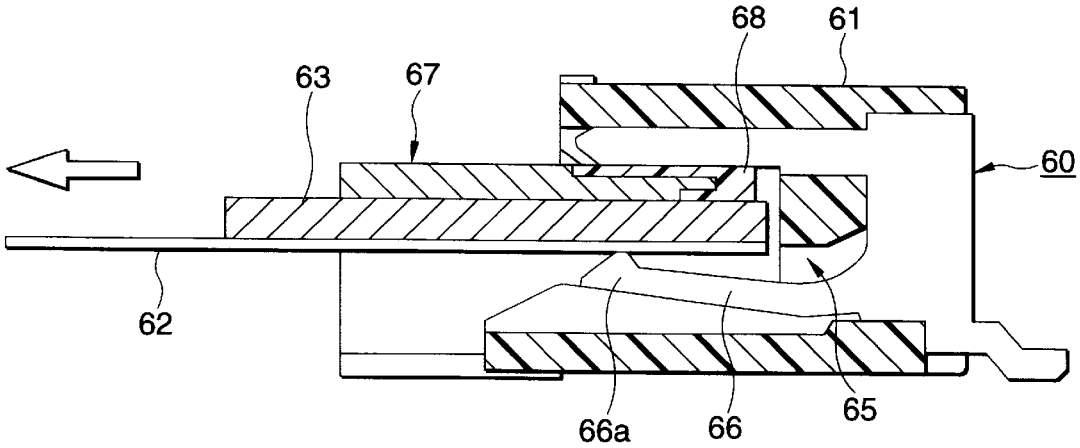
FIG. 5 PRIOR ART
FIG. 5 is a cross-sectional view of a conventional FPC cable connection connector.

Then, the lid member 27 is pressed against the housing 20 until the elongate projection 28 covers the rear end of each terminal 15 while the elongate projection 29 is inserted between the contact surfaces 18 and 18, thereby fixing the lid member 27 to the housing 20, as shown in FIG. 4.

At this time, the end portion of the flat circuit member 12 is held by the contact portions 17 and 17 of each terminal 15 and also between the elongate projection 29 and each of the contact surfaces 18 and 18, so that a first bent portion 14*a* of a substantially convex shape is formed at the end portion of the flat circuit member 12. Also, that portion of the flat circuit member 12, disposed adjacent to the end portion thereof in the longitudinal direction, is held between the elongate projection 28 and the rear end of each terminal 15 and also between the elongate projection 28 and the housing 20, so that a second bent portion 14*b* of a substantially crank-shape is formed at this predetermined portion of the flat circuit member 12.

Namely, the flat circuit member 12 is fixed to the housing 20 against disengagement therefrom through the first bent portion 14*a* and the second bent portion 14*b*.

In the flat circuit member connector 10 of the above construction, the first bent portion 14*a* of the flat circuit member 12 is disposed between the contact surfaces 18 and 18 of each terminal 15, so that the flat circuit member 12 is fixed, with each conductor portion 13 held in press-contact with the contact surfaces 18 and 18 of the corresponding terminal 15. Therefore, even when the flat circuit member 12 is pulled in the longitudinal direction away from the housing 20, the flat circuit member 12 will not be easily disengaged from the housing 20, and the housing can be positively kept connected to the flat circuit member 12.

Particularly in this flat circuit member connector 10, the flat circuit member 12 is fixed to the housing 20 not only by the first bent portion 14*a* but also by the second bent portion 14*b*, and therefore the housing can be positively kept connected to the flat circuit member 12.

In the flat circuit member connector 10, the flat circuit member 12, having the first and second bent portions 14*a* and 14*b* formed respectively at the predetermined portions thereof, is held in a gripped manner, and with this very simple construction, the flat circuit member 12 is fixed to the housing 20. Therefore, as compared with the conventional construction, the number of the component parts is reduced, and the production cost can be reduced.

And besides, in this flat circuit member connector 10, each terminal 15 is disposed in surface-to-surface contact with the corresponding conductor portion 13 of the flat circuit member 12 through the contact surfaces 18 and 18 and the planar contact portions 17 and 17, and therefore the electric resistance value can be obtained in a stable manner even under severe conditions in which severe vibrations are applied to the connector, and this eliminates the possibility of incomplete connection as encountered in the conventional construction.

In the flat circuit member connector 10, the area of contact between each conductor portion 13 of the flat circuit member 12 and each contact surface 18 of the terminal 15, as well as the area of contact between the conductor portion 13 and each contact portion 17 of the terminal 15, is covered with the lid member 27, and therefore these contact areas are protected from dirt, dust, water and so on, and besides adverse effects, caused by an impact, a drag and others, can be relieved.

In this flat circuit member connector 10, the flat circuit member 12 can be bent into a substantially crank-shape at its second bent portion 14*b*, and therefore the housing 20 can be more positively kept connected to the flat circuit member 12 as compared with the case where the flat circuit member 12 is bent into a substantially L-shape.

And besides, in this flat circuit member connector 10, the flat circuit member 12 is bent into a substantially convex shape at its first bent portion 14*a*, and therefore the housing 20 can be more positively kept connected to the flat circuit member 12 as compared with the case where the flat circuit member 12 is merely bent into a substantially L-shape.

In this flat circuit member connector 10, the pair of contact surfaces 18 and 18 of each terminal 15 are held in surface-to-surface contact with the corresponding conductor portion 13 of the flat circuit member 12, and therefore the area of contact of the terminal 15 with the conductor portion 13 of the flat circuit member 12 increases, and this further reduces the possibility of incomplete connection due to severe vibrations.

The present invention is not limited to the above embodiment, but suitable modifications and improvements can be made.

For example, in the above embodiment, although the flat circuit member is bent into a convex shape, and is held in a gripped manner, the flat circuit member can be bent, for example, into a substantially L-shape or a substantially crank-shape.

In the above embodiment, although the end portion of the flat circuit member is fixed, the housing can be fixed to any desired portion of the flat circuit member in the longitudinal direction as indicated by the chain double-dashed lines in FIGS. 3 and 4.

With this arrangement, the flat circuit member connector of the present invention can be used as a branch connector for flat circuit members.

The material, shape, dimensions, form, number, arrangement and etc., of the flat circuit member, the terminals, the housing, the fixing mechanism and so on are not limited to the illustrated embodiment, but can be arbitrary in so far as the present invention can be achieved.

As described above, in the present invention, the flat circuit member is fixed in such a manner that the bent portion of the flat circuit member is held in press-contact with the contact surfaces of the terminal extending in the direction of the thickness thereof, and therefore the housing can be positively kept connected to the flat circuit member, and the number of the component parts is reduced as compared with the conventional construction, and the incomplete connection as encountered in the conventional construction can be avoided.

In the present invention, the area of contact between each conductor portion of the flat circuit member and each contact surface of the terminal is covered with the lid member, and therefore the contact area is protected from dirt, dust, water and so on, and besides adverse effects, caused by an impact, a drag and others, can be relieved.

In the present invention, the flat circuit member can be bent into a substantially crank shape, that is, that portion of the flat circuit member, disposed immediately adjacent to the distal end portion thereof bent into a substantially L-shape, can be bent into a substantially L-shape, and therefore the housing can be more positively kept connected to the flat circuit member as compared with the case where the flat circuit member is merely bent into a substantially L-shape.

In the present invention, the flat circuit member is fitted into the space between the pair of opposed contact surf aces of each terminal in a substantially convexly-bent manner, an therefore the housing can be more positively kept connected to the flat circuit member as compared with the case where the flat circuit member is merely bent into a substantially L-shape or a substantially crank-shape.

What is claimed is:

1. A connector, comprising:

a housing;

a plurality of terminals receivable in the housing, the terminals having at least one contact surface extended in a thickness direction thereof;

a partition plate that is integral with said housing and that separates said plurality of terminals into two rows to be arranged in a direction perpendicular to a thickness direction of said housing; and at least one fixing mechanism fixable to the housing, wherein when the fixing mechanism is fixed to the housing so that a flat circuit member having a conductor portion is held between the housing in which the terminal is received and the fixing mechanism, the fixing mechanism bends a part of the flat circuit member in a thickness direction thereof at least partially around said contact surface to form a bent portion on the flat circuit member, and presses the bent portion of the flat circuit member against the contact surface of the terminal so that the terminal is electrically connected to the conductor portion of the flat circuit member.

2. The connector of claim 1, wherein the terminal has a pair of the contact surfaces, and wherein the pair of contact surfaces are spaced a predetermined distance from each other in a longitudinal direction of the terminal, and are opposed to each other.

3. The connector of claim 1, wherein the fixing mechanism includes a lid member having at least one projection, and wherein when the fixing mechanism is fixed to the housing, the flat circuit member is held between the projection and a rear end of the terminal and also between the projection and the housing.

4. The connector of claim 1, wherein the fixing mechanism includes at least one recess portion formed in the housing so that the contact surface of the terminal is exposed to an exterior through the recess portion, and a lid member fittable in the recess portion to cover the recess portion, and wherein the bent portion is held between the recess portion and the lid member.

5. The connector of claim 4, wherein the flat circuit member can be bent by the fixing mechanism into a substantially crank shape.

6. The connector of claim 4, wherein the lid member has a projection fittable in the recess portion, so that the bent portion is held between the projection and the recess portion.

7. The connector of claim 4, wherein the fixing mechanism includes a lid member having at least one projection, and wherein when the fixing mechanism is fixed to the housing, the flat circuit member is held between the projection and a rear end of the terminal and also between the projection and the housing.

8. The connector of claim 1, wherein said fixing mechanism presses said bent portion of the flat circuit member against the contact surface of the terminal without piercing a surface of said flat circuit member.

9. The connector of claim 8, wherein said bent portion of the flat circuit member makes surface-to-surface contact with said terminal when pressed by said fixing mechanism.

10. The connector of claim 4, wherein said recess portion is formed on an upper surface and a lower surface of said partition plate.

11. The connector of claim 10, wherein said lid member is fittable in said recess portion formed on said upper and lower surfaces of said partition plate.

12. A connector, comprising:

a housing;

a plurality of terminals receivable in the housing, the terminals having at least one contact surface extended in a thickness direction thereof;

a partition plate that is integral with said housing and that separates said plurality of terminals into two rows to be arranged in a direction perpendicular to a thickness direction of said housing; and at least one fixing mechanism fixable to the housing, wherein when the fixing mechanism is fixed to the housing so that a flat circuit member having a conductor portion is held between the housing in which the terminal is received and the fixing mechanism, the fixing mechanism bends a part of the flat circuit member in a thickness direction thereof to form a bent portion thereon, and presses the bent portion of the flat circuit member against the contact surface of the terminal so that the terminal is electrically connected to the conductor portion of the flat circuit member;

wherein said fixing mechanism presses said bent portion of the flat circuit against the contact surface of the terminal without piercing a surface of said flat circuit member.

* * * * *